US005257000A

United States Patent [19]

Billings et al.

[11] Patent Number: 5,257,000

[45] Date of Patent: Oct. 26, 1993

[54] CIRCUIT ELEMENTS DEPENDENT ON CORE INDUCTANCE AND FABRICATION THEREOF

[75] Inventors: Robert L. Billings, Richardson, Tex.; Donald W. Dahringer, Glen Ridge; Alan M. Lyons, New Providence, both of N.J.

[73] Assignee: AT&T Bell Laboratories, Murray Hill, N.J.

[21] Appl. No.: 835,793

[22] Filed: Feb. 14, 1992

[51] Int. Cl.[5] ..... H01F 5/00

[52] U.S. Cl. ..... 336/200; 336/223; 336/229; 29/412; 29/602.1; 29/606

[58] Field of Search ..... 29/606, 602.1, 412; 336/200, 221, 223, 229

[56] References Cited

U.S. PATENT DOCUMENTS

| | | | |
|---|---|---|---|
| 3,765,082 | 10/1973 | Zyetz | 29/602.1 |
| 4,117,588 | 10/1978 | Johnson | 29/602.1 |
| 4,342,976 | 8/1982 | Ryser | 336/84 |
| 4,536,733 | 8/1985 | Shelly et al. | 336/182 |
| 4,755,783 | 7/1988 | Fleischer et al. | 336/84 |
| 4,975,671 | 12/1990 | Dirks | 336/200 |
| 5,055,816 | 10/1991 | Altman et al. | 336/200 |

FOREIGN PATENT DOCUMENTS

| | | | |
|---|---|---|---|
| 58522 | 1/1954 | France | 29/606 |
| 35511 | 2/1991 | Japan | 29/602.1 |
| 219606 | 9/1991 | Japan | 29/602.1 |

OTHER PUBLICATIONS

*Microelectronics Packaging Handbook*, R. Tummala, E. J. Rymaszewski, eds., Van Nostrand Reinhold, New York, pp. 885–909 (1989).

*Printed Circuits Handbook*, C. F. Coombs, Jr., ed., 3rd ed., chapters 12 and 13, McGraw-Hill, New York (1988).

*Handbook of Flexible Circuits*, Ken Gilleo, ed., Van Nostrand Reinhold, New York (1992).

*Primary Examiner*—P. W. Echols

*Attorney, Agent, or Firm*—George S. Indig

[57] ABSTRACT

Magnetic circuit elements, e.g. for inclusion on circuit boards including one or more windings about a toroidal core are produced by joinder of mating sheets, one or both recessed to hold the core, and each containing partial windings. Joinder is by use of an anisotropically conducting adhesive layer. The layer is applied as an uncured thermosetting adhesive containing spherical conducting particles of such size and distribution as to statistically result in electrical completion of windings while avoiding turn-to-turn shorting.

18 Claims, 4 Drawing Sheets

CIRCUIT ELEMENTS DEPENDENT ON CORE INDUCTANCE AND FABRICATION THEREOF

BACKGROUND OF THE INVENTION

1. Technical Field

The invention is concerned with the fabrication of small circuit elements which, as generally now fabricated, entail wire winding of a soft magnetic core. An important class of elements includes transformers and inductors based on toroidal or other magnetically ungapped cores. Contemplated structures may be discrete elements or sub-assemblies, e.g. for incorporation on circuit boards. They may be constructed in situ to constitute an integral part of a circuit.

2. Description of the Prior Art

Wire wound core structures such as toroidal inductors and transformers are expensive to fabricate—generally entail turn-by-turn hand or machine winding. Relative to other circuit elements, e.g. resistors, capacitors, etc., they contribute disproportionately to the cost of completed circuitry. The problem is most pronounced for ungapped core elements in which cost is due to complex apparatus/processing associated with the turn-by-turn insertion-extraction operation of winding. Cost is aggravated by the trend toward decreasing device size.

The prevailing commercial approach continues to depend on machine or hand winding of coil turns about toroidal cores. Recognition of the problem is evidenced by proposed alternatives revealed in patent/literature study. These include: winding with multiple turns of flex circuitry, largely as constituted of parallel conductive paths (see, U.S. Pat. Nos. 4,342,976, dated Aug. 3, 1982 and 4,755,783, dated May 7, 1988; provision of parallel paths by drilling and through-plating followed by metallizing and delineating on an insulating magnetic sheet (U.S. Pat. No. 5,055,816 dated Oct. 8, 1991; as well as a variety of approaches entailing mating of boards supporting half-circuits with windings completed mechanically by use of conductive clips (see U.S. Pat. No. 4,536,733, dated Aug. 20, 1985.

TERMINOLOGY

Winding or Wire Wound

This terminology, as used by the artisan, refers to coils or turns however produced. In context, it is used to refer to functionally equivalent alternatives to the literal encircling wire of the prior art.

SUMMARY OF THE INVENTION

The inventive teaching importantly relies on joining of mating bonds supporting partial or "half" coils by means of anisotropically conducting adhesive—to simultaneously complete coil windings. Completed windings are constituted of surface-supported segments on the boards together with penetrating surface-to-surface board segments. Properly designed adhesive consists of a dispersion, generally of uniformly dimensioned conductive particles—illustratively and, in fact, likely spherical or near-spherical, of appropriate size and number to permit simultaneous completion of partial turns to result in coil completion. As described in detail, such "anisotropic adhesives" as constituted in accordance with the present state of the art, provide sufficient redundancy of conductive paths to statistically provide for adequate assurance of completion of individual windings while avoiding turn-to-turn shorting. Most satisfactory anisotropic adhesives at this time, e.g. "Ad-Con" as referenced below, likely depend on an epoxy-based or other thermosetting adhesive vehicle. A number of mechanisms may provide for otherwise yield-reducing imperfections. Perhaps prime, surface roughness of regions containing half-coil terminations may be accommodated by flexible or plastic deformation in bearing surfaces, by use of prolate or oblate spheres, and/or by distortion or fracture of spheres during joinder. Available adhesive vehicles are sufficient to maintain joinder, likely as assisted by clamping during setting.

Coil completion as described is assured by mating conductive pads of enlarged mating surface through which coil segments are conductively connected. Such pads may be formed lithographically, perhaps from foil, perhaps from deposited material. Board-penetrating segments are expediently produced by through-plating of holes which are drilled or otherwise formed in the circuit board sheet to be mated—likely of glass reinforced plastic or of other suitable electrically insulating material. Surface-supported segments may be formed lithographically.

Continuous, magnetically ungapped looped cores—e.g. toroids, "squareoids"—are contained within recesses. As shown in the drawing, the core may be contained within a single recess in one of the boards, or, alternatively, mating recesses of reduced depth may be provided in both boards. Embodiments based on the latter approach entail mated through-plated holes solely in both boards. Embodiments based on the first approach may be based on mated through-plated holes as well. An alternative structure is based on penetrating segments in the recessed board, with coil completion accomplished by contacting surface-supported segments on the underside of the unrecessed board.

It is expected that prevalent use of the teaching will entail simultaneous construction of many such "wire wound" structures. A single circuit or circuit module may include a plurality of inductors or transformers. The inventive approach is likely to be used in fabrication of large boards which may later be subdivided into individual circuits or modules.

Importantly, the inventive teaching permits design flexibility to lessen compromise as to numbers as well as size of elements. Simultaneous provision of turn segments of a given class—surface-supported or through-plated—as well as of turn completion during joinder, substantially reduces cost implications of increasing numbers of coil turns.

It is expected that initial use will take the form of manufacture of discrete devices or modules to be included in subsequently assembled circuits. The inventive procedures lend themselves to such fabrication as well as to final circuit assemblies. It is contemplated, too, that the approach will be used for direct fabrication of elements in situ, to result in circuits containing other elements—e.g. resistors, capacitors, air core or gapped wound structures, etc.

DETAILED DESCRIPTION

The Drawing

Figure 1:
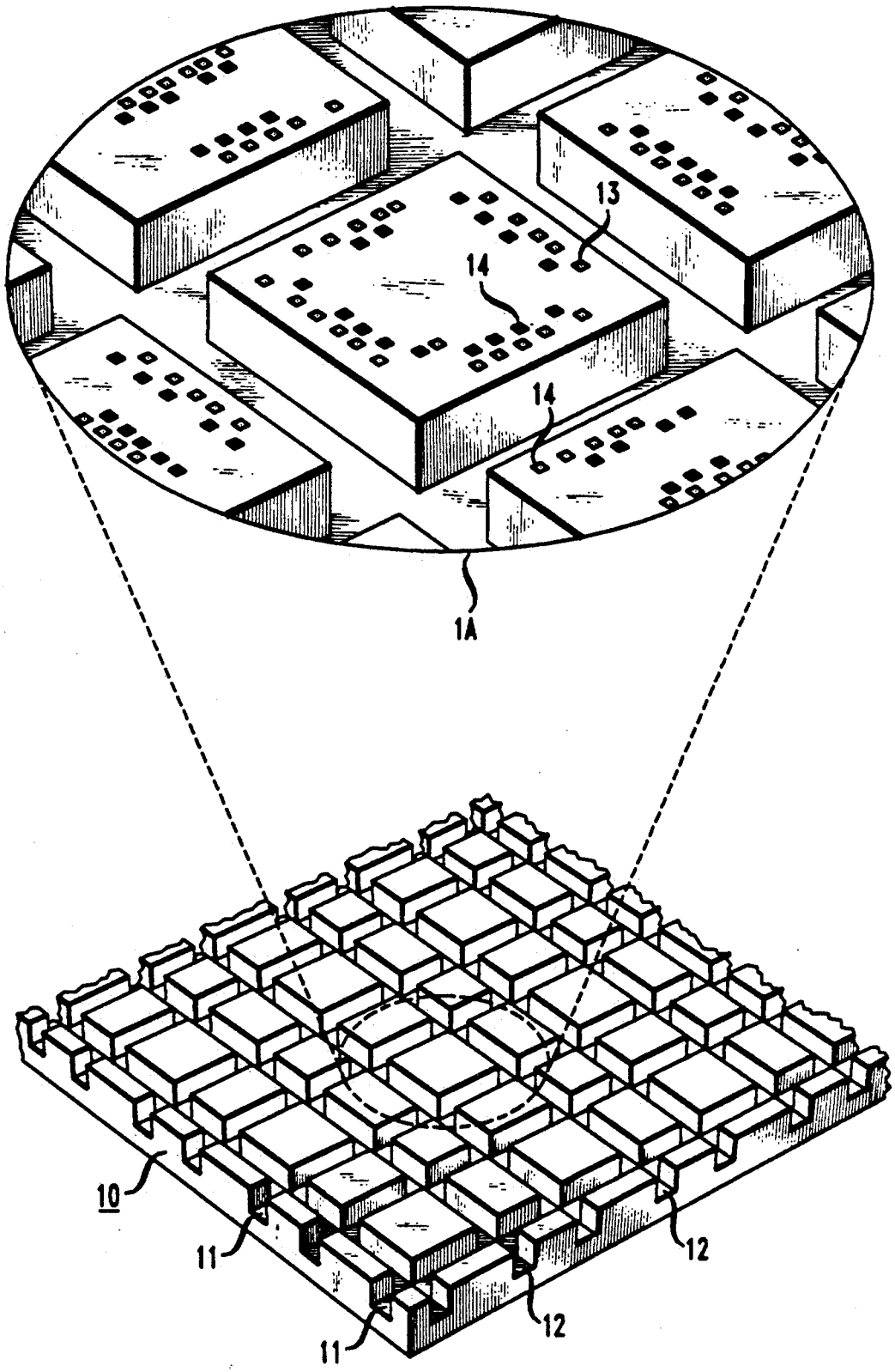
FIG. 1 is a perspective view depicting a portion of a device in fabrication—showing one of the two mating sheets as recessed for core acceptance and as provided with coil turn mating pads.

FIG. 1 depicts a board 10 which may be of glass fiber-strengthened epoxy—e.g. "FR-4". Recesses for housing the cores, in this instance, square cores, are provided by intersecting recessed grooves 11 and 12. For an experimental structure using a squareoid of 0.25 in. overall size, housing grooves were of 0.033 in. depth and 0.058 in. width in the 0.047 in. thickness board. Core legs, not shown, were of 0.060 in. height×0.050 in. width cross-section. The enlarged view 1A shows pads 13 and 14 as formed in contact with through-plated conductors, not shown. In conformity with an expected early use, pads 13 and 14 may be considered as corresponding with primary and secondary transformer turn segments, respectively.

An experimental model depended on machining—on sawing or grinding for grooves, and on drilling for through connection. It used 28-turn coils together with cores of overall size 0.25 in. Quantity production may make use of other forms of machining or may make use of molding.

Figure 2:
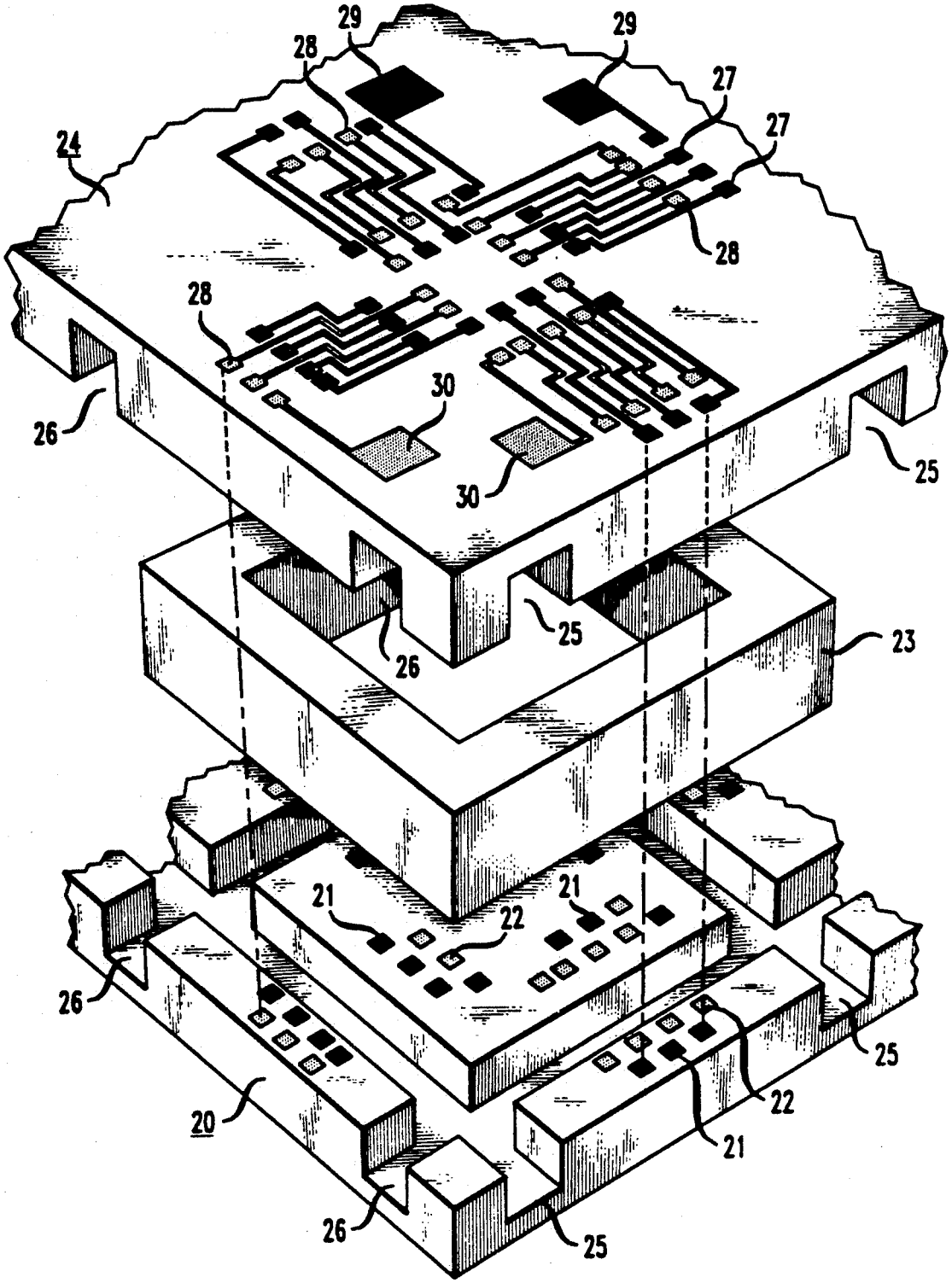
FIG. 2 is an exploded view, in perspective, showing a single device region as in FIG. 1A together with a core—in this instance, a "squareoid", and with the mating portion of the second sheet, the latter as provided with printed conductors for completing coil turns. The depicted embodiment provides for mating recesses in both sheets for housing the core.

FIG. 2 depicts a formed sheet 20 which may be regarded as corresponding with that of sheet 10 of FIG. 1. Primary and secondary pads are here numbered 21 and 22, respectively. Soft magnetic core, e.g. ferrite core, 23—an ungapped toroidal core or "squareoid"—is shown prior to sandwiching between sheets 20 and 24. For the embodiment shown, sheets 20 and 24 are recessed by slots 25 and 26 to define mating, half thickness recesses for accepting core 23. Printed circuitry shown on the upper surface of sheet 24 includes primary segments, terminating in pads 27 for completing turns including through-plated conductors associated with pads 21 and secondary segments, terminating in pads 28 for completing turns including pads 22. Pads are shown as enlarged to ease registration requirements with through-plated holes and to accommodate a particular AdCon composition. Pads 29 and 30 serve for terminal connection.

Figure 3:
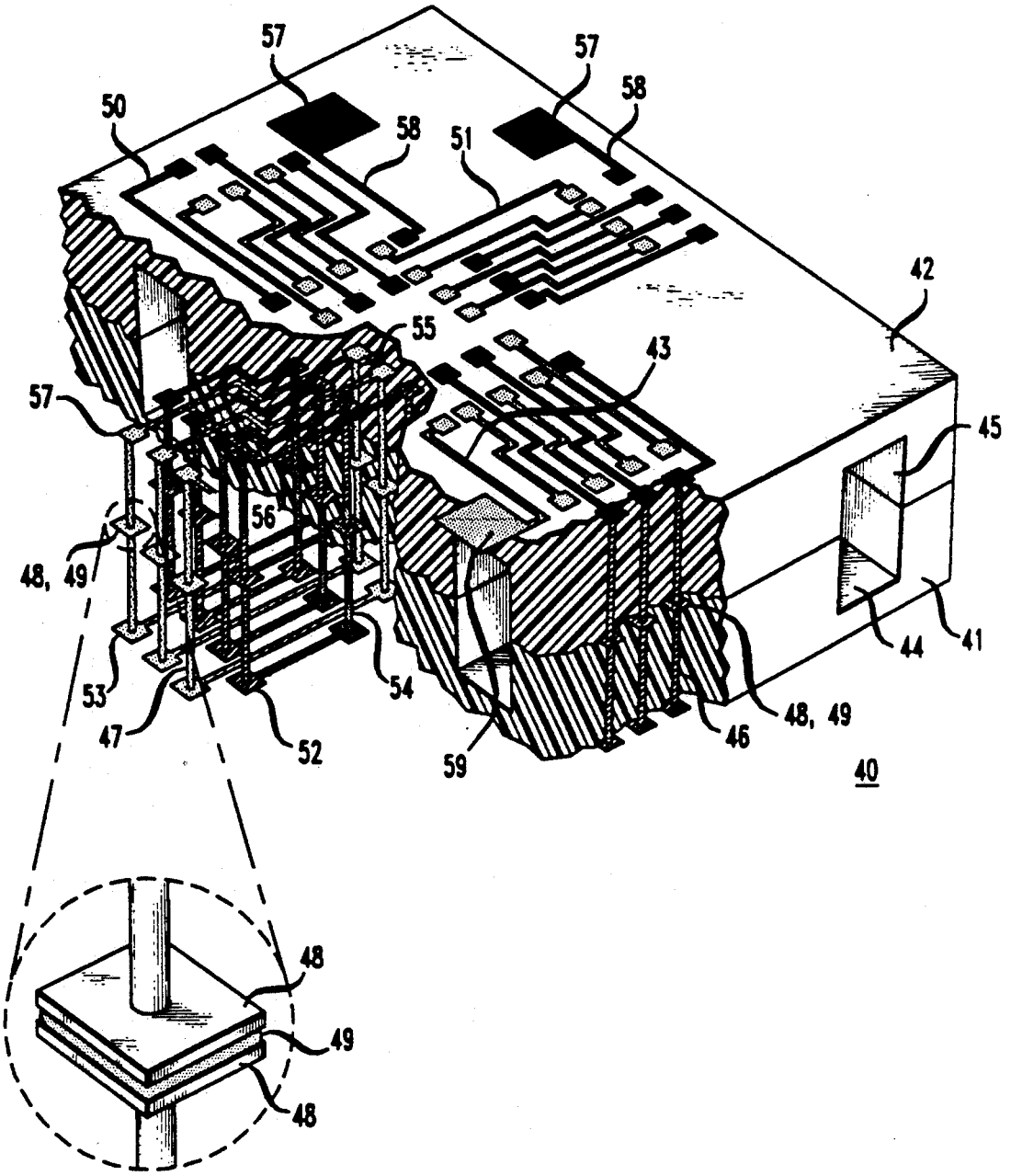
FIG. 3 is a cutaway perspective view depicting a completed circuit element as yielded by the successive stages shown in FIGS. 1 and 2—to be regarded as a discrete device, as included within a module, or as an in situ constructed device within a circuit—e.g. within a hybrid circuit.

FIG. 3, in depicting the now-assembled element 40, includes mating sheets 41 and 42 corresponding with sheets 20 and 24 of FIG. 2. A magnetic core, not shown, e.g. a ferrite core such as core 23 of FIG. 2 is now housed in mated half recesses 44 and 45. Coil turns or "windings", primary turns 46 and secondary turns 47, are now completed via pads 48, in turn, joined by anisotropic bonding layer 49. Segments 50 and 51 on the upper surface of sheet 42 together with segments 52 and 53, in conjunction with through-plated conductors 54 and 55, as connected through anisotropically bonded pads 48 complete the "windings". Contact pads 57 and associated printed wires 58 provide access to the primary coil. For the structure depicted, the secondary coil is accessed by wires 43 together with pads 59 (only one shown).

Such segments may be constructed of foil or by a variety of printing techniques such as used in integrated circuitry, or by stenciling.

Figure 4:
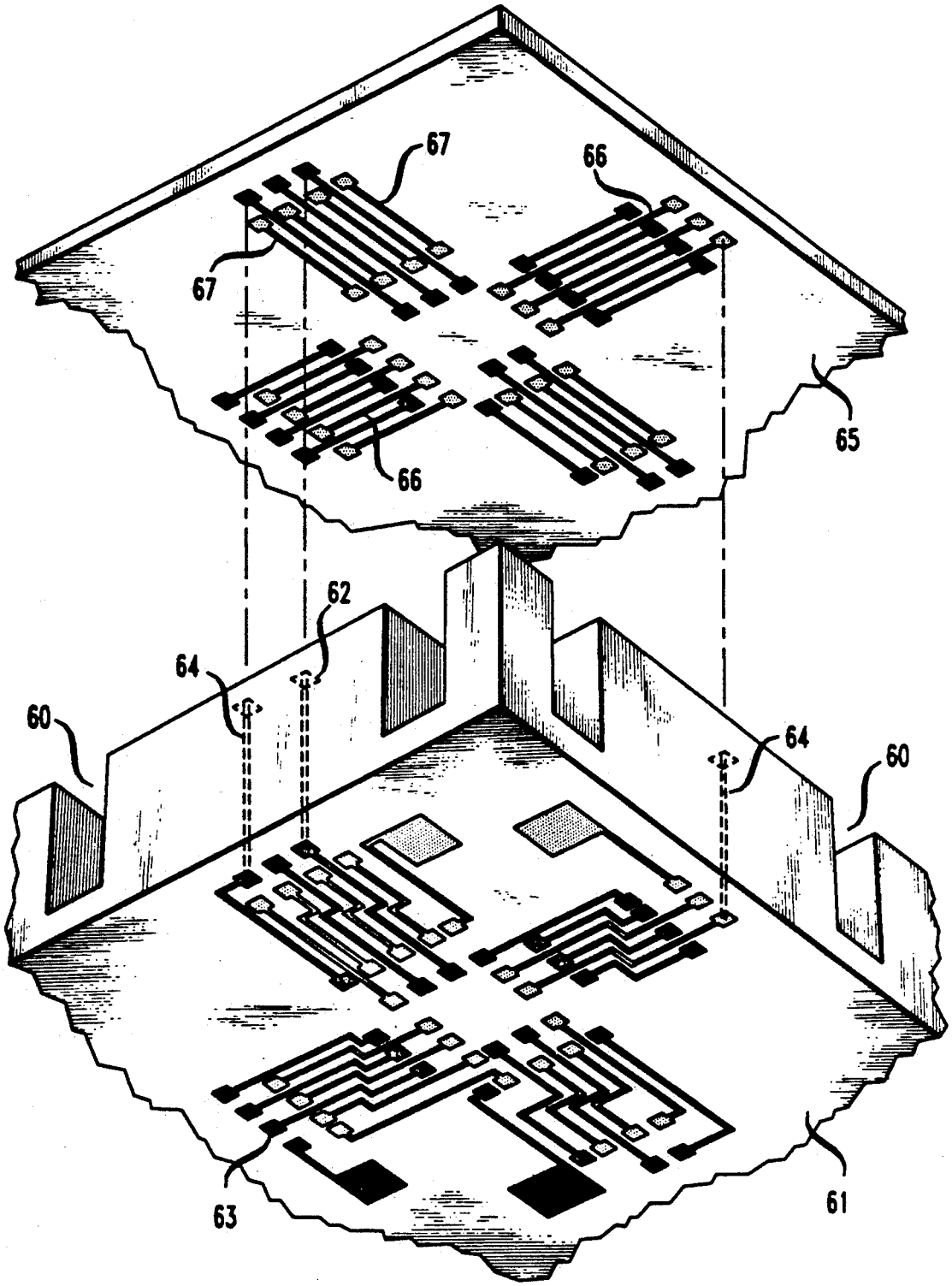
FIG. 4 is an exploded view, in perspective, showing an embodiment in which the core is to be entirely housed in one of the two boards. For the particular embodiment shown, circuit completion is by means of surface-supported segments on the underside of the unrecessed mating board.

FIG. 4 represents the embodiment in which the core member, not shown, is housed in recesses 60 provided within a single board 61. Windings may be completed as in FIG. 3, by use of pads 62 and 63 together with through-plated holes 64. The same arrangement may be used in unrecessed board 65, or, alternatively, as in one experimental structure, may depend on pad-terminated segments 66 and 67 provided on the underside, contacting surface of board 65.

Process Outline

Contemplated process steps are set forth in general terms with indication of likely processing parameters. Description is largely for structures in which housing of cores is shared between mating recesses. The alternative approach depends on a single housing recess together with a mating unrecessed board as shown in FIG. 4. For such approach, the recessed board may be designed and fabricated in the same manner.

Description is with the objective of aiding the practitioner, and as such, include steps ancillary to the inventive teaching itself. Specific order as well as parameters are to be considered illustrative only, and not to constitute further limitation on appended claims. Support sheets are suitably circuit boards in state-of-the-art use. An illustrative product known as FR-4 is based on glass fiber reinforced plastic. (See, *Microelectronics Packaging Handbook*, pp. 885-909, R. R. Tummala and E. J. Rymaszewski, ed., Van Nostrand Reinhold, N.Y. (1989)). To first approximation, overall thickness of mated boards results in mechanical integrity similar to that of prior art devices using single boards of that overall thickness. The final product includes coil structures consisting of coil turns, each composed of face segments on one face on each of the two boards to be interconnected by through-plated holes and mating pads as discussed. Such coils, as so defined, encompass magnetic cores sandwiched between the boards.

Boards are provided with holes to be through-plated as well as recesses for accommodating cores. Experimentally, such shaping has been accomplished by machining—by drilling and sawing. Appropriate choice of materials may expedite quantity production by shaping, as by molding, during initial preparation of the boards or subsequently. While alternatives are feasible, surface-supported conductive regions on the boards—face-supported turn segments and associated contact pads as well as interconnect pads associated with through-plated holes—may be formed lithographically. Experimental structures have made use of copper foil bonded to both surfaces, and it is likely this approach will be used initially. Alternatively, and perhaps better suited to smaller design rules, metallization may take other forms as presently used in IC manufacture.

In experimental models, holes were drilled and through-plated. Through-plating entailed two steps—(a) electroless plating, (b) followed by electroplating. This, as well as suitable alternative procedures are well-known. Relevant materials, temperatures, times, etc. are set forth in a number of publications, see, for example, *Printed Circuits Handbook*, chapters 12 and 13, C. F. Coombs, Jr., ed. 3rd. ed., McGraw-Hill, N.Y. (1988).

Face-supported conductor layers are patterned, for example, by photolithography. Alternative approaches, perhaps carried out at this stage, entail selective deposition as by screen printing or stenciling through an apertured mask. (A representative literature reference is *Handbook of Flexible Circuits*, pp. 198–209, Ken Gilleo, ed., Van Nostrand Reinhold, N.Y. (1992)). On the assumption of usual photolithographic delineation, as initiated by provision of a continuous unpatterned conductive layer, the surface is now exposed and developed to allow removal of unwanted conductive material. Boards, if not already shaped by machining or molding, may be shaped at this stage to accommodate cores.

A variety of considerations may yield to preference for but a single rather than mated recess. Containment of the core structure in a single board may permit thinning of the unrecessed board, with operational or economic advantage. Mating interconnect pads are now coated with anisotropically conducted adhesive. The exemplary material, AdCon, as applied, consists of uncured thermosetting resin loaded with the particles responsible for pad-to-pad conduction. (See, "Surface Mount Assembly of Devices Using AdCon Connections", U.S. patent application Ser. No. 755,704, filed Sep. 6, 1991. A typical AdCon composition consists of mixed diglycidyl ether of bisphenol-A epoxy and an amine curing agent, serving as suspension medium for the particles. Compositions, used in one set of experiments, contained from 5 to 15 vol. % of uniformly dimensioned 10–20 μm diameter spheres of silver plated glass. Likely initial manufacture will be directed toward discrete elements or sub-assemblies. Subdivision follows curing of the adhesive. In-situ formation directed toward final circuit fabrication has likely been attended by simultaneous process steps e.g. directed toward construction of other devices as well as associated circuitry. In some instances, prior as well as subsequent processing, directed toward incorporation of other circuit elements, may be indicated.

Dimensions

Dimensions listed are those used in experimental structures. For the most part, while relevant to likely initial fabrication, it is expected that they will undergo significant reduction in size, in part as permitted by the inventive approach.

Interconnection pads—10×15 mil pads statistically result in ≈25 particle-interconnection paths as based on the AdCon example above.

Lines—turn segments or other circuitry—of dimension 5 mil wide by 0.7 mil high, were based on "half ounce copper foil".

Terminal pads providing for electrical connection to coils were 50×50 mil.

Cores—toroids or "squareoids"—were of 250 mil overall dimension—60 mil high by 50 mil wide on a side. Experimental structures made use of magnetically soft "MnZn" ferrite cores. In general, core material is soft and constituted of domain magnetic material—ferrimagnetic or ferromagnetic. Permeability is likely within the range of from 10 to 20,000.

We claim:

1. Fabrication entailing construction of at least one magnetic circuit element comprising at least one winding consisting essentially of at least one turn of electrically conductive material about an ungapped core of soft magnetic material, said at least one turn being produced by joinder of turn members, characterized in that said element is supported by sandwiching boards at least one of which is recessed to enclose such core, in that each such turn consists essentially of electrically conductive segments including a first surface-supported segment on one such board and a second surface-supported segment on the second such board, together with two board-penetrating segments, so positioned that sandwiching accomplishes electrical joinder of segment portions to result in electrical completion of such turn, and in that joinder entails adhesion of at least regions of mating surfaces of said boards by use of a vehicle, said vehicle consisting essentially of adhesive containing electrically conductive particles of such size and distribution as to statistically join such segment portions, while adhesively bonding such sandwiching boards, so as to complete such turn, while avoiding unwanted electrical interconnection entailing any such segment, at least one said region including at least two segment portions to be electrically joined, further in which board-penetrating segments consist essentially of holes rendered electrically conductive by end-to-end inner plating, and in which segment portions to be joined are provided with conductive pads of enlarged area relative to cross-sectional area of board-penetrating segments.

2. Fabrication of claim 1 in which such winding includes a plurality of turns.

3. Fabrication of claim 2 entailing construction of a plurality of such circuit elements.

4. Fabrication of claim 3 entailing severance of sandwiching boards subsequent to joinder so yielding at least one entity selected from the group consisting of discrete devices and modules and circuits.

5. Fabrication of claim 1 in which surface-supported segments on at least one such board are fabricated from a continuous layer by photolithographic delineation.

6. Fabrication of claim 5 in which such photographic delineation entails formation of ancillary circuitry.

7. Fabrication of claim 6 in which such ancillary circuitry includes circuit elements selected from the group consisting of at least one of resistors, capacitors, air core structures and gapped wound structures.

8. Fabrication of claim 1 in which said adhesive is thermosetting.

9. Fabrication of claim 8 in which particles are spherical, oblate, or prolate.

10. Fabrication of claim 9 in which included particles are substantially spherical and of approximately equal size.

11. Fabrication of claim 10 in which included particles are coated with electrically conductive material.

12. Fabrication of claim 11 in which included particles consist of coated dielectric spheres.

13. Fabrication of claim 1 in which both sandwiching boards are recessed so that the said core is enclosed within mating recesses and in which each of the said boards contains board-penetrating segments so that each turn includes four board-penetrating segments.

14. Fabrication of claim 1 in which but one of the said boards is recessed thereby yielding one recessed board and one unrecessed board.

15. Fabrication of claim 14 in which both the recessed board and the unrecessed board contain board-penetrating segments.

16. Fabrication of claim 14 in which only the said recessed board contains board-penetrating segments.

17. Fabrication of claim 16 in which surface-supported segments are on the underside of the unrecessed board.

18. Article produced by the fabrication of any of claims 1–17.

* * * * *